US009956783B2

(12) United States Patent
Barkley et al.

(10) Patent No.: US 9,956,783 B2
(45) Date of Patent: May 1, 2018

(54) LOCAL HUMIDIFICATION FOR FLUIDIC DISPENSING DEVICES

(71) Applicant: Funai Electric Co. Ltd., Osaka (JP)

(72) Inventors: Lucas D. Barkley, Lexington, KY (US); Michael A. Marra, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days. days.

(21) Appl. No.: 15/284,574

(22) Filed: Oct. 4, 2016

(65) Prior Publication Data

US 2018/0093513 A1 Apr. 5, 2018

(51) Int. Cl.

| | |
|---|---|
| ***B41J 2/17*** | (2006.01) |
| ***B41J 2/14*** | (2006.01) |
| ***B41J 2/045*** | (2006.01) |
| ***B41J 2/165*** | (2006.01) |

(52) U.S. Cl.

CPC ..... *B41J 2/1714* (2013.01); *B41J 2/04566* (2013.01); *B41J 2/1433* (2013.01); *B41J 2/165* (2013.01); *B41J 2002/1655* (2013.01); *B41J 2002/16564* (2013.01); *B41J 2002/16573* (2013.01)

(58) Field of Classification Search

CPC ..... B41J 2/04566; B41J 2/165; B41J 2002/1655; B41J 2002/16564; B41J 2002/16573; B41J 2/1714

See application file for complete search history.

(56) References Cited

U.S. PATENT DOCUMENTS

| | | | | |
|---|---|---|---|---|
| 2010/0066787 | A1 | 3/2010 | Yokouchi et al. | |
| 2010/0079515 | A1* | 4/2010 | Kuwahara ..... | B41J 2/16585 347/7 |
| 2011/0109689 | A1 | 5/2011 | Sugimoto et al. | |
| 2011/0109690 | A1 | 5/2011 | Kida et al. | |
| 2011/0316942 | A1 | 12/2011 | Koyama | |
| 2012/0162311 | A1 | 6/2012 | Taira | |

* cited by examiner

*Primary Examiner* — Julian Huffman

(74) *Attorney, Agent, or Firm* — Luedeka Neely Group, P.C.

(57) ABSTRACT

A fluidic dispensing device includes a first fluid supply containing a primary fluid and a second fluid supply containing a humidification fluid. A plurality of primary nozzles in fluid communication with the first fluid supply eject the primary fluid and a plurality of humidification nozzles in fluid communication with the second fluid supply eject the humidification fluid for controlling a humidity of an environment adjacent the plurality of primary nozzles.

18 Claims, 5 Drawing Sheets

LOCAL HUMIDIFICATION FOR FLUIDIC DISPENSING DEVICES

FIELD

This disclosure relates to fluidic dispensing devices. More particularly, this disclosure relates to fluidic ejection head assemblies having improved humidification control of a local environment adjacent the primary nozzles of the fluidic ejection heads.

BACKGROUND

Fluidic ejection heads are useful for ejecting a variety of fluids including inks, cooling fluids, pharmaceuticals, lubricants and the like. A widely used fluidic ejection head assembly is in an inkjet printer.

With reference to FIG. 1, a representative portion of an exemplary and simplified prior art fluidic ejection head 10 is provided. As shown, the primary components of a fluidic ejection head 10 are a nozzle plate 12 attached, such as by adhesive 14, to a surface 16 of a semiconductor substrate 18. The semiconductor substrate 18 is preferably made of silicon and contains various passivation layers, conductive metal layers, resistive layers, insulative layers, and/or protective layers. Fluid ejection actuators 20, such as thermal actuators or piezoelectric actuators, are provided on the substrate surface 16. For thermal actuators, individual heater resistors are defined in the resistive layers of the nozzle plate 12 and each heater resistor corresponds to a nozzle hole 22 in the nozzle plate 12 for heating and ejecting fluid from the fluidic ejection head 10 toward a desired substrate or target.

Fluid receiving channels 24 and fluid chambers 26 for providing fluid to each of the ejection actuators 20 of the fluid ejection head 10 are either formed in the nozzle plate material or in a separate film layer. Upon activation of fluid ejection actuators 20, fluid is supplied to the fluid receiving channels 24 and fluid chambers 26 from a fluid feed channel 28 or fluid via that is in fluid communication with a fluid storage supply (as represented in FIG. 3). The fluid feed channel 28 is typically formed by chemically etching, dry etching, or grit blasting through the semiconductor substrate 18. The fluid receiving channels 24, fluid chambers 26, and fluid feed channel 28 of the fluidic ejection head 10 are collectively referred to herein as a "fluid supply channel."

Referring to FIG. 2, a nozzle plate 12 of a fluid ejection head 10 typically contains hundreds of microscopic nozzle holes 22 for ejecting fluid therefrom. A plurality of nozzle plates 12 are typically fabricated in a polymeric film using laser ablation or other micro-machining techniques. Individual nozzle plates 12 are excised from the film, aligned, and attached to a plurality of substrates 18 on a multi-chip wafer so that the nozzle holes 22 align with the ejection actuators 20.

Referring to FIG. 3, an exemplary inkjet printing cartridge is shown with a fluidic ejection head 10 attached to a fluid storage supply 30. The fluid storage supply 30 includes a flexible circuit 32 containing electrical contacts 34 thereon for providing control and actuation of the fluid ejector actuators 20 on the substrate 12 via conductive traces 36. One or more fluid storage supplies 30 with attached fluidic ejection heads 10 may be used in a fluidic dispensing device, such as an inkjet printer, to provide control and ejection of fluid from the ejection heads 10 onto a target media.

One of the major variables in the operational efficiency of a fluidic ejection head 10 is controlling the viscosity of the fluid ejected from the nozzles 22. In this regard, many of the ejection fluids of a fluidic dispensing device contain pigments, dyes, and other volatiles. As the volatiles evaporate, the viscosity of the fluid in the fluid storage supply 30 become too viscous to be accurately and efficiently ejected. The rate and amount of evaporation of the volatiles is directly affected by the temperature and humidity of a local environment surrounding the fluidic ejection head 10. For purposes of the present disclosure, the "local environment" is considered the area adjacent nozzles 22 generally between the fluidic ejection head 10 and the target media when the target media is loaded in the fluid dispensing device. Similarly, another cause of failure of a fluidic ejection head 10 is fluid drying on the ejection head's nozzles 22 and the corresponding fluid supply channel.

While one known solution to prevent evaporation of the volatiles and drying of the fluid is to provide a cap or seal that covers the nozzles 22 of the fluidic ejection head 10 when the device is not in use, fluidic ejection heads 10 are often disposed in a small and/or closed environment (such as an inkjet printer) that makes it difficult to cover the nozzles 22. Further, even when the ejection head 10 is capped or sealed, the seal is often ineffective, particularly in long periods of inactivity of the fluidic dispensing device.

Accordingly, what is desired is a fluidic dispensing device that promotes improved efficiency in ejecting fluid by maintaining desired humidity levels at the local environment surrounding the device's fluidic ejection heads.

SUMMARY

The present disclosure is directed to a fluidic dispensing device including a first fluid supply containing a primary fluid and a second fluid supply containing a humidification fluid. A plurality of primary nozzles are in fluid communication with the first fluid supply for ejecting the primary fluid. A plurality of humidification nozzles are in fluid communication with the second fluid supply for ejecting the humidification fluid and controlling a humidity of an environment adjacent the plurality of primary nozzles.

According to certain embodiments, the fluidic dispensing device further includes a humidification substrate disposed adjacent the plurality of humidification nozzles for absorbing the humidification fluid ejected from the plurality of humidification nozzles. According to this embodiment, a heating device may be disposed adjacent the humidification substrate for assisting in evaporation of the humidification fluid absorbed by the humidification substrate.

According to certain embodiments, the fluidic dispensing device further includes at least one humidity sensor for measuring at least one of the temperature and humidity of the environment adjacent the plurality of primary nozzles. According to this embodiment, the fluidic dispensing device may further include a humidification controller in communication with the humidity sensor for controlling the ejection of the humidification fluid from the plurality of humidification nozzles based at least in part on readings from the humidity sensor. According to certain embodiments, the humidification controller actuates the plurality of humidification nozzles when the humidity sensor determines that the humidity of the environment adjacent the plurality of primary nozzles is less than about 50% relative humidity. According to other embodiments, the humidification controller actuates the plurality of humidification nozzles for a first amount of humidification fluid when the humidity sensor determines that the humidity of the environment adjacent the plurality of primary nozzles is between about 30% and 50% relative humidity and actuates the plurality of humidification nozzles for a second amount of humidification fluid when the humidity sensor determines that the humidity of the environment adjacent the plurality of primary nozzles is less than about 30% relative humidity, wherein the second amount of humidification fluid is greater than the first amount.

According to other embodiments, the humidification controller controls the ejection of the humidification fluid from the plurality of humidification nozzles according to a humidity control algorithm. According to this embodiment, the humidity control algorithm may actuate the plurality of humidification nozzles for a first amount of humidification fluid when the humidity sensor determines that the humidity of the environment adjacent the plurality of primary nozzles is within a predetermined range and may actuate the plurality of humidification nozzles for a second amount of humidification fluid when the humidity sensor determines that the humidity is less than the predetermined range, wherein the second amount of humidification fluid is greater than the first amount.

According to other embodiments, the humidification controller controls the ejection of the humidification fluid from the plurality of humidification nozzles according to predetermined intervals.

According to certain embodiments, the fluidic dispensing device further includes a primary fluid supply channel for delivering the primary fluid from the first fluid supply to the plurality of primary nozzles and a humidification fluid supply channel for delivering the humidification fluid from the second fluid supply to the plurality of humidification nozzles.

According to certain embodiments, the fluidic dispensing device further includes a fluidic ejection head, and the plurality of primary nozzles and the plurality of humidification nozzles are disposed within the same fluidic ejection head.

According to certain embodiments, the plurality of humidification nozzles includes a first set of humidification nozzles disposed adjacent a first end of the plurality of primary nozzles and a second set of humidification nozzles disposed adjacent a second end of the plurality of primary nozzles.

According to another embodiment of the disclosure, a method for maintaining desired humidity levels of a fluidic dispensing device includes providing one or more fluidic ejection heads including a first fluid supply containing a primary fluid, a second fluid supply containing a humidification fluid, a plurality of primary nozzles in fluid communication with the first fluid supply for ejecting the primary fluid, and a plurality of humidification nozzles in fluid communication with the second fluid supply for ejecting the humidification fluid; and ejecting the humidification fluid from the plurality of humidification nozzles for controlling the humidity levels of an environment adjacent the plurality of primary nozzles.

According to certain embodiments, the humidification fluid is ejected from the plurality of humidification nozzles according to predetermined intervals. According to other embodiments, the fluidic dispensing device includes one or more humidity sensors and the humidification fluid is ejected from the plurality of humidification nozzles based at least in part on readings from the one or more humidity sensors. According to this embodiment, the plurality of humidification nozzles may be actuated during the ejecting step for ejecting a first amount of humidification fluid when the one or more humidity sensors determine that the humidity of the environment adjacent the plurality of primary nozzles is within a predetermined range and may be actuated for ejecting a second amount of humidification fluid when the one or more humidity sensors determine that the humidity is less than the predetermined range, wherein the second amount of humidification fluid is greater than the first amount.

According to certain embodiments, the fluidic dispensing device includes a humidification substrate disposed adjacent the plurality of humidification nozzles for absorbing the humidification fluid ejected from the plurality of humidification nozzles. According to this embodiment, a heating device is disposed adjacent the humidification substrate for assisting in evaporation of the humidification fluid absorbed by the humidification substrate, and the method further includes activating the heating device upon ejecting the humidification fluid from the plurality of humidification nozzles.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
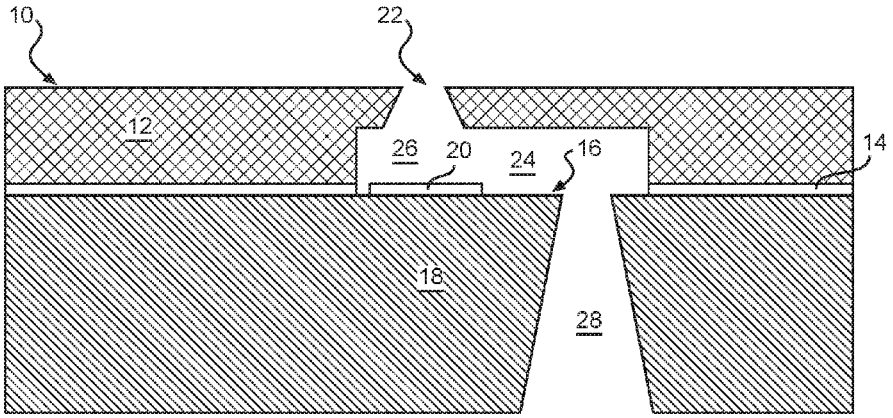
FIG. 1 PRIOR ART
FIG. 1 depicts a cross-sectional view of a portion of an exemplary prior art fluidic ejection head.
Figure 2:
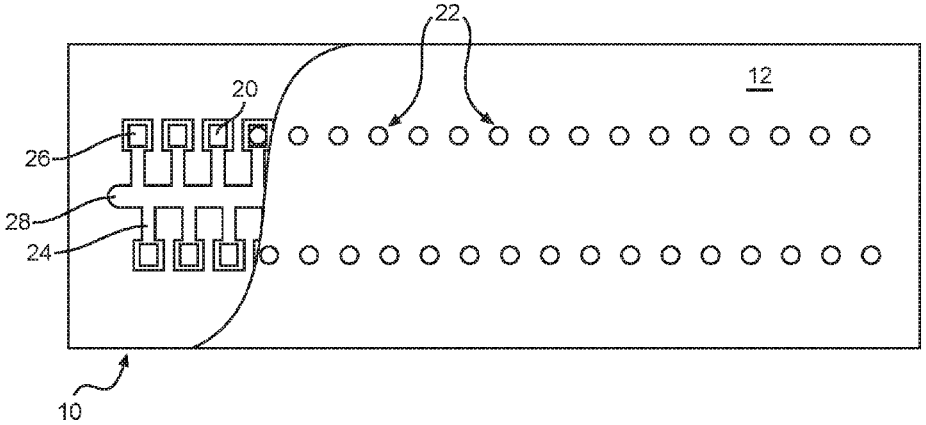
FIG. 2 PRIOR ART
FIG. 2 is a plan view, not to scale, of the prior art fluidic ejection head of FIG. 1.
Figure 3:
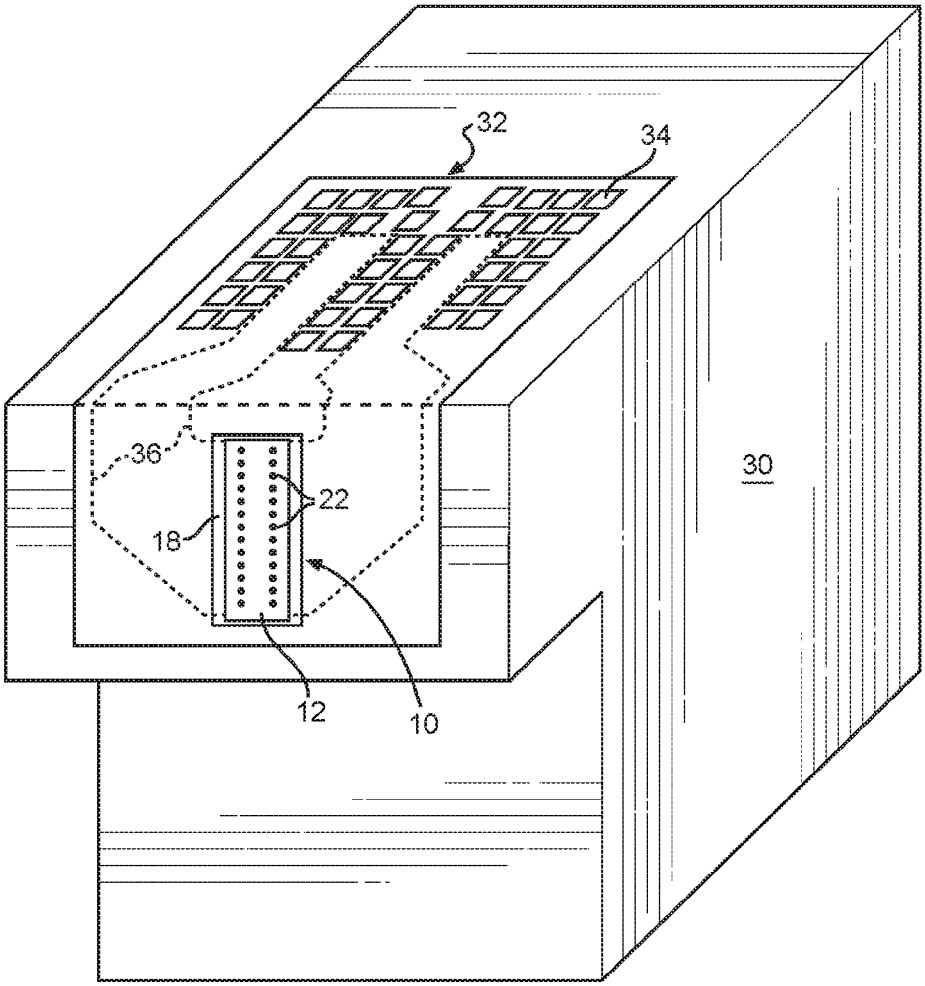
FIG. 3 PRIOR ART
FIG. 3 is a perspective view of a fluid cartridge including a fluidic ejection head.
Figure 4:
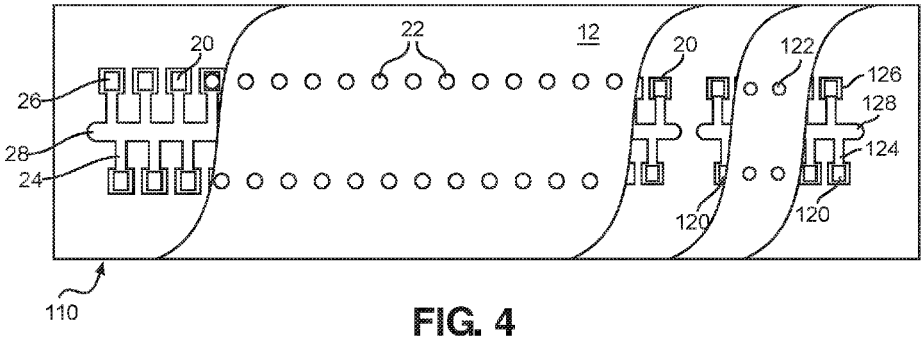
FIG. 4 is a plan view, not to scale, of a fluidic ejection head according to one embodiment of the disclosure.

With reference to FIG. 4, a fluidic ejection head 110 according to one embodiment of the present disclosure is provided. Fluidic ejection head 110 is configured similarly to ejection head 10 depicted in FIGS. 1-2 except that it includes two distinct sets of nozzles each connected to a distinct fluid supply channel. In preferred embodiments, the fluidic ejection head 110 is a microfluidic ejection head. The first set of nozzles 22 are substantially as described above with respect to FIGS. 1-2 and are in fluid communication with a first fluid supply for ejecting a primary fluid to a target media, such as ink when the dispensing device is an inkjet printer. Thus, nozzles 22 are referred to herein as "primary nozzles" and are in fluid communication with the first fluid supply via a primary fluid supply channel containing fluid receiving channels 24, fluid chambers 26, and fluid feed channel 28. The components of the primary fluid supply channel are controlled by primary fluid ejection actuators 20 as described above.

While the primary nozzles 22 are used to eject the primary fluid, the second set of nozzles 122 are in fluid communication with a second fluid supply containing a humidification fluid that is to be ejected into the local environment adjacent the fluidic ejection head 110. Thus, nozzles 122 are referred to herein as "humidification nozzles." According to preferred embodiments, the humidification fluid is pure water, or water with additives as known in the art that tend to enhance the desired humidification behavior of humidifiers. Similar to primary nozzles 22, ejection of the humidification fluid from humidification nozzles 122 is preferably controlled by humidification fluid ejection actuators 120. Upon activation of humidification fluid ejection actuators 120, humidification fluid is supplied to fluid receiving channels 124 and fluid chambers 126 from a dedicated humidification fluid feed channel 128 that is in fluid communication with the second fluid supply. In operation, the humidification fluid passed through the humidification fluid supply channel and ejected from the humidification nozzles 122 is used to maintain a higher humidity level of the local environment adjacent the primary nozzles 22, which allows the fluidic ejection head 110 to remain inactive for a much longer period of time before becoming inoperative or increasingly inaccurate.

Figure 5:
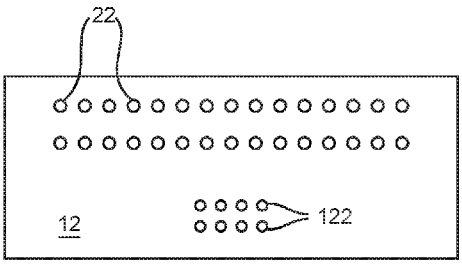
FIG. 5 is a plan view, not to scale, of a fluidic ejection head according to another embodiment of the disclosure.
Figure 6:
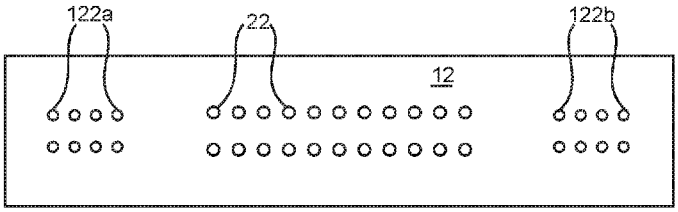
FIG. 6 is a plan view, not to scale of a fluidic ejection head according to yet another embodiment of the disclosure.

While FIG. 4 represents one particular array of primary nozzles 22 and humidification nozzles 122, it should be understood that countless other configurations are possible and within the scope of the present disclosure. For example, with reference to FIG. 5, humidification nozzles 122 may be disposed above or below primary nozzles 22 instead of being disposed on one side of the primary nozzles 22 as depicted in FIG. 4. Further, according to certain embodiments and with reference to FIG. 6, the humidification nozzles 122 may be divided into multiple sets such as a first set of humidification nozzles 122*a* adjacent one end of primary nozzles 22 and a second set of humidification nozzles 122*b* adjacent an opposite end of primary nozzles 22. Additionally, depending on the particular application of fluidic ejection head 110 and the type of primary fluid ejected from the primary nozzles 22, the amount of humidification fluid needed to maintain desired humidity levels of the local environment should be minimal in most cases. Thus, the humidification fluid reservoir is typically much smaller than the primary fluid reservoir. Similarly, as best exemplified in FIGS. 4-5, the number of humidification nozzles 122 of each fluidic ejection head 110 is typically less than the number of primary nozzles 22. In such instances, the humidification feed channel 128 takes up less space than the primary fluid feed channel 28 due to the fewer number of humidification nozzles 122. Further, in certain embodiments, the size (e.g., diameter) of the humidification nozzles 122 and associated humidification fluid receiving channels 124, fluid chambers 126, and feed channel 128 may be smaller than the primary nozzles 22 and associated channels 24, chambers 26, and feed channel 28. Accordingly, incorporation of a secondary dispensing channel 128 and associated nozzles 122 dedicated to providing humidification fluid to the local environment should typically not require a significant amount of space in the ejection head 110 or corresponding fluid cartridge. However, in certain embodiments where more humidification fluid may be needed, the number and/or size of the humidification feed channel 128 and associated nozzles 122 may be generally the same as, or even greater than, the number and/or size of the primary feed channel 28 and associated primary nozzles 22.

According to alternate embodiments, that humidification nozzles 122 may be provided on their own nozzle plate 12, fluidic ejection head, or even own fluid cartridge as opposed to being combined with primary nozzles 22 as shown. In other words, a fluidic dispensing device according to the present disclosure could include one or more fluidic ejection heads and/or fluid cartridges devoted entirely to ejecting a humidification fluid into a local environment adjacent fluidic ejection heads 10 having only primary nozzles 22.

Figure 7:
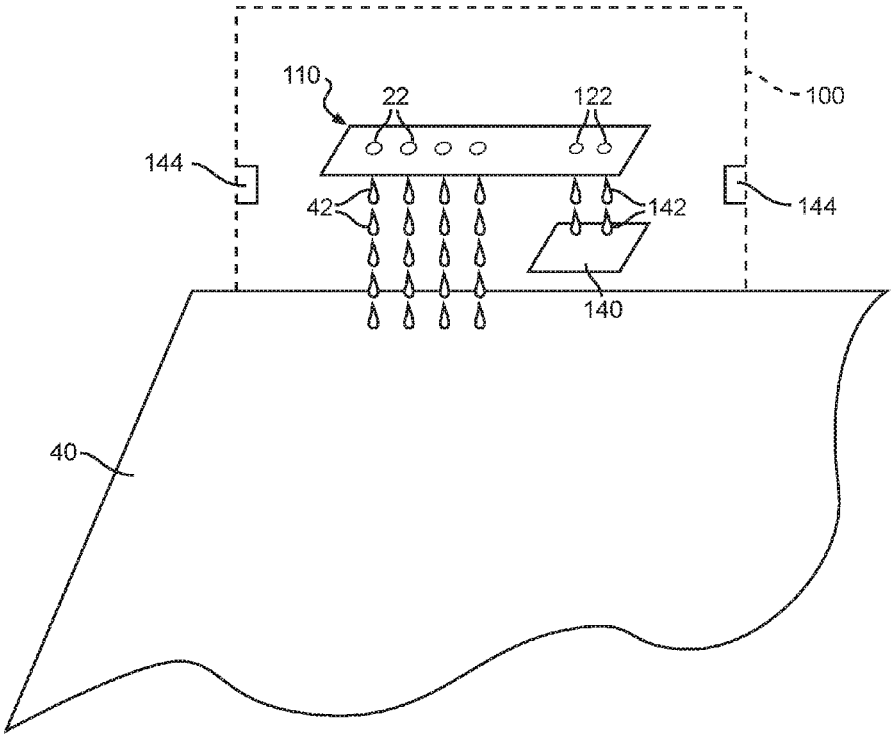
FIG. 7 is a schematic view of a fluidic dispensing device having a fluidic ejection head for ejecting primary fluid on a target media according to one embodiment of the disclosure.

According to certain embodiments, humidification nozzles 122 are operable to eject very small droplets of humidification fluid such that the humidification fluid becomes easily airborne and quickly evaporates upon ejection to the local environment adjacent the fluidic ejection head 110. However, according to other embodiments and with reference to FIG. 7, a humidification substrate 140, such as a sponge, foam, etc., is provided to absorb the humidification fluid 142 ejected from the humidification nozzles 122 of the fluidic ejection head 110. While the exact manner in which the humidification substrate 140 is secured to the ejection head 110 and/or fluidic delivery device 100 is not critical, the humidification substrate 140 is positioned and configured to absorb the humidification fluid 142 while allowing the primary fluid 42 to be ejected from primary nozzles 22 onto the target media 40. According to certain embodiments, a low powered heater is secured to the humidification substrate 140, or provided adjacent to the humidification nozzles 122 particularly in embodiments that do not include a humidification substrate 140, to encourage and speed up evaporation of the humidification fluid even in low temperature environments.

Figure 8:
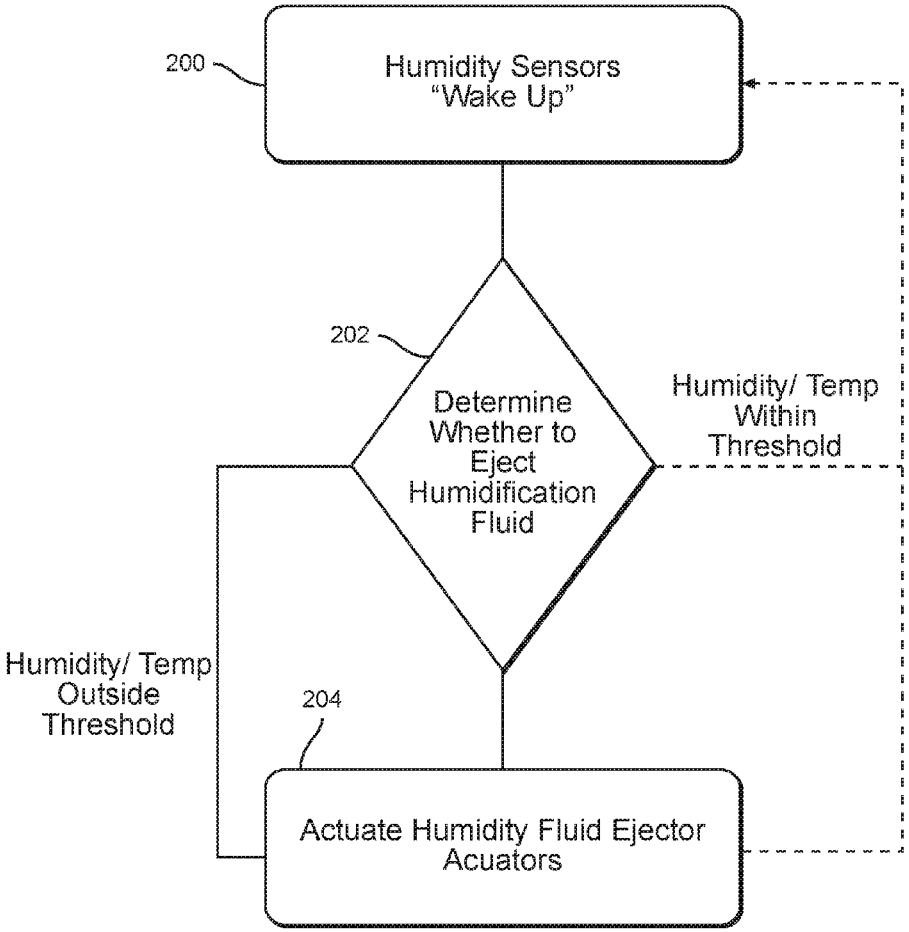
FIG. 8 is a flowchart depicting a humidity control algorithm according to one embodiment of the disclosure.

According to preferred embodiments, the fluidic delivery device 100 includes one or more humidity and/or temperature sensors 144 for determining when to eject humidification fluid from the humidification nozzles 122. For purposes of the present disclosure, sensors having a moisture sensing element, temperature sensing element, or both are collectively referred to as a "humidity sensor." According to certain embodiments, the circuitry 32 of the fluidic dispensing device includes a humidification controller that is in communication with the one or more humidity sensors 144 and is executing a local humidity control algorithm. The humidification controller according to this embodiment provides control and actuation of the humidification fluid ejector actuators 120 according to the humidity control algorithm. For example, referring to the flowchart of FIG. 8, the humidity control algorithm is set up so that the humidity sensors 144 "wake up" at prescribed intervals in step 200 and measure the temperature and/or humidity of the local environment. At step 202, the humidity control algorithm determines whether to eject the humidification fluid 142 from the humidification nozzles 122. In this regard, when the temperature and/or humidity readings are within a predetermined threshold, the humidity sensors 144 go back to "sleep" until the next prescribed interval in which the sensors 144 are to measure the local environment. On the other hand, when the temperature and/or humidity readings are outside the predetermined threshold, the humidity control algorithm actuates the humidification fluid ejector actuators 120 at step 204 to eject the humidification fluid 142 into the local environment. After ejecting the humidification fluid 142 into the local environment, the process starts over at step 200 by waking up the humidity sensors 144 according to the prescribed intervals set by the humidity control algorithm. Alternately, the humidity sensors 144 are constantly measuring the local environment and communicate with the humidification controller to actuate the humidification fluid ejector actuators 120 when the temperature and/or humidity readings are outside the predetermined threshold. In embodiments where the dispensing device includes a humidification substrate 140 and associated low powered heater for encouraging evaporation of the humidification fluid 142, the humidification controller may also actuate the heater when it activates the humidification fluid ejector actuators 120 in step 204.

It has been found that typical inkjet printers and associated inks tend to show issues related to evaporation when the humidity of the local environment is below about 30% and have very little issues above about 50%. Thus, according to certain embodiments, the ejector actuators 120 are actuated in step 204 for a pre-specified number of fires and/or to eject a specified amount of humidification fluid when the relative humidity of the local environment is between a specified range, such as about 30% and 50%. On the other hand, if the relative humidity is less than about 30%, actuators 120 are actuated for a greater pre-specified number of fires (i.e., a greater amount of humidification fluid). If the relative humidity of the local environment is greater than about 50%, the actuators 120 are not activated and the humidity sensors 144 go back to sleep. It should be understood these are merely example ranges and other preferred thresholds may be incorporated depending on application requirements. Humidity sensors 144 may also incorporate temperature readings in combination with relative humidity to actuate actuators 120 based on absolute humidity readings and/or a more sophisticated algorithm could be employed, such as a proportional-integral-derivative control algorithm.

According to alternate embodiments, the humidity sensors 144 may be omitted and the humidity control algorithm is programmed to actuate the humidification fluid ejector actuators 120 according to predetermined intervals. In other words, the humidification fluid ejector actuators are actuated at predetermined intervals regardless of the actual humidity of the local environment.

The foregoing description of preferred embodiments for this disclosure has been presented for purposes of illustration and description. The description and embodiments are not intended to be exhaustive or to limit the disclosure to the precise forms disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A fluidic dispensing device comprising:

a first fluid supply containing a primary fluid;

a second fluid supply containing a humidification fluid;

a plurality of primary nozzles in fluid communication with the first fluid supply for ejecting the primary fluid onto a target substrate;

a plurality of humidification nozzles in fluid communication with the second fluid supply for ejecting the humidification fluid and controlling a humidity of an environment adjacent the plurality of primary nozzles; and a humidification substrate positioned between the plurality of humidification nozzles and the target substrate for absorbing the humidification fluid ejected from the plurality of humidification nozzles while allowing the primary fluid to be ejected from the plurality of primary nozzles onto the target substrate.

2. The fluidic dispensing device of claim 1 further comprising a heating device disposed adjacent the humidification substrate for assisting in evaporation of the humidification fluid absorbed by the humidification substrate.

3. The fluidic dispensing device of claim 1 further comprising at least one humidity sensor for measuring at least one of the temperature and humidity of the environment adjacent the plurality of primary nozzles.

4. The fluidic dispensing device of claim 3 further comprising a humidification controller in communication with the humidity sensor for controlling the ejection of the humidification fluid from the plurality of humidification nozzles based at least in part on readings from the humidity sensor.

5. The fluidic dispensing device of claim 4 wherein the humidification controller actuates the plurality of humidification nozzles when the humidity sensor determines that the humidity of the environment adjacent the plurality of primary nozzles is less than about 40% relative humidity.

6. The fluidic dispensing device of claim 4 wherein the humidification controller actuates the plurality of humidification nozzles for a first amount of humidification fluid when the humidity sensor determines that the humidity of the environment adjacent the plurality of primary nozzles is between about 30% and 40% relative humidity and actuates the plurality of humidification nozzles for a second amount of humidification fluid when the humidity sensor determines that the humidity of the environment adjacent the plurality of primary nozzles is less than about 30% relative humidity, wherein the second amount of humidification fluid is greater than the first amount.

7. The fluidic dispensing device of claim 1 further comprising a humidification controller for controlling the ejection of the humidification fluid from the plurality of humidification nozzles according to a humidity control algorithm.

8. The fluidic dispensing device of claim 7 wherein the humidity control algorithm actuates the plurality of humidification nozzles for a first amount of humidification fluid when the humidity sensor determines that the humidity of the environment adjacent the plurality of primary nozzles is within a predetermined range and actuates the plurality of humidification nozzles for a second amount of humidification fluid when the humidity sensor determines that the humidity is less than the predetermined range, wherein the second amount of humidification fluid is greater than the first amount.

9. The fluidic dispensing device of claim 1 further comprising a humidification controller for controlling the ejection of the humidification fluid from the plurality of humidification nozzles according to predetermined intervals.

10. The fluidic dispensing device of claim 1 further comprising:

a primary fluid supply channel for delivering the primary fluid from the first fluid supply to the plurality of primary nozzles; and a humidification fluid supply channel for delivering the humidification fluid from the second fluid supply to the plurality of humidification nozzles.

11. The fluidic dispensing device of claim 1 further comprising a fluidic ejection head and wherein the plurality of primary nozzles and the plurality of humidification nozzles are disposed within the same fluidic ejection head.

12. The fluidic dispensing device of claim 1 wherein the plurality of humidification nozzles includes a first set of humidification nozzles disposed adjacent a first end of the plurality of primary nozzles and a second set of humidification nozzles disposed adjacent a second end of the plurality of primary nozzles.

13. A method for maintaining desired humidity levels of a fluidic dispensing device, the method comprising:

providing one or more fluidic ejection heads including a first fluid supply containing a primary fluid, a second fluid supply containing a humidification fluid, a plurality of primary nozzles in fluid communication with the first fluid supply for ejecting the primary fluid onto a target substrate, a plurality of humidification nozzles in fluid communication with the second fluid supply for ejecting the humidification fluid, and a humidification substrate positioned between the plurality of humidification nozzles and the target substrate for absorbing the humidification fluid ejected from the plurality of humidification nozzles while allowing the primary fluid to be ejected from the plurality of primary nozzles onto the target substrate; and ejecting the humidification fluid from the plurality of humidification nozzles for controlling the humidity levels of an environment adjacent the plurality of primary nozzles.

14. The method of claim 13 wherein the humidification fluid is ejected from the plurality of humidification nozzles according to predetermined intervals.

15. The method of claim 13 wherein the fluidic dispensing device includes one or more humidity sensors, wherein the humidification fluid is ejected from the plurality of humidification nozzles based at least in part on readings from the one or more humidity sensors.

16. The method of claim 15 wherein the plurality of humidification nozzles are actuated during the ejecting step for ejecting a first amount of humidification fluid when the one or more humidity sensors determine that the humidity of the environment adjacent the plurality of primary nozzles is within a predetermined range and are actuated for ejecting a second amount of humidification fluid when the one or more humidity sensors determine that the humidity is less than the predetermined range, wherein the second amount of humidification fluid is greater than the first amount.

17. The method of claim 13 further comprising a heating device disposed adjacent the humidification substrate for assisting in evaporation of the humidification fluid absorbed by the humidification substrate.

18. The method of claim 17 further comprising activating the heating device upon ejecting the humidification fluid from the plurality of humidification nozzles.

* * * * *